US006414637B2

(12) United States Patent
Keilen

(10) Patent No.: US 6,414,637 B2
(45) Date of Patent: Jul. 2, 2002

(54) DUAL FREQUENCY WIDEBAND RADIATOR

(75) Inventor: Donald H. Keilen, Sparks, NV (US)

(73) Assignees: Rangestar Wireless Inc., Aptos, CA (US); Tyco Electronic Logistics AG (CH)

( * ) Notice: Subject to any disclaimer, the term of this patent is extended or adjusted under 35 U.S.C. 154(b) by 0 days.

(21) Appl. No.: 09/776,617

(22) Filed: Feb. 2, 2001

Related U.S. Application Data

(60) Provisional application No. 60/180,428, filed on Feb. 4, 2000.

(51) Int. Cl.[7] ..... H01Q 1/38
(52) U.S. Cl. ..... 343/700 MS; 343/846
(58) Field of Search ..... 343/700 MS, 702, 343/752, 829, 846, 848; H01Q 1/38

(56) References Cited

U.S. PATENT DOCUMENTS 5,526,003 A * 6/1996 Ogawa et al. ..... 343/700 MS
5,917,450 A * 6/1999 Tsunekawa et al. .. 343/700 MS
6,002,367 A * 12/1999 Engblom et al. .... 343/700 MS
6,049,314 A * 4/2000 Munson et al. ..... 343/846
6,100,849 A * 8/2000 Tsubaki et al. ..... 343/702
6,140,966 A * 10/2000 Panknaho ..... 343/700 MS

* cited by examiner

*Primary Examiner*—Tho Phan
(74) *Attorney, Agent, or Firm*—Fulbright & Jaworski L.L.P.

(57) ABSTRACT

A dual frequency wideband antenna assembly for use in a wireless communication device. The antenna assembly includes a first radiating element having two substantially collateral arms with a dielectric member therebetween and a second radiating element having two substantially collateral arms also with a dielectric member therebetween. A conducting element operatively connects the first and second radiating elements to each other in an adjacent and substantially coplanar relation. The assembly is spaced a predetermined distance from the ground plane of a printed wiring board and is operatively connected thereto at several predetermined locations by several components. One component, a capacitor, operatively couples one of the arms of the first radiating element to a ground plane while other components, namely a feed element and a grounding element operatively connect one of the arms and a portion of the second radiating element, respectively, to the ground plane. Various componentry may be positioned within the open space(s) between the antenna assembly and the ground plane to facilitate compact construction.

20 Claims, 5 Drawing Sheets

DUAL FREQUENCY WIDEBAND RADIATOR

This application claims the benefit of U.S. Provisional Application No. 60/180,428 filed Feb. 4, 2000.

FIELD OF THE INVENTION

The present invention relates to an antenna assembly suitable for wireless transmission of analog and/or digital data, and more particularly to a dual frequency, wideband radiator.

BACKGROUND OF THE INVENTION

There are a variety of antennas which are currently used in wireless communication devices. One type of antenna is an external half wave single or multi-band dipole. This antenna typically extends or is extensible from the body of a wireless communication device in a linear fashion. Because of the physical configuration of this type of antenna, electromagnetic waves radiate equally toward and away from a user. Thus, there is essentially no front to back ratio and little or no specific absorption rate (SAR) reduction. Specific absorption rates for this type of antenna are typically 2.7 mw/g at a 0.5 watt transmission power level. With multi-band versions of this type of antenna, resonances are achieved through the use of inductor-capacitor (LC) traps. With this antenna, gains of +2 dBi are common. While this type of antenna is acceptable in some wireless communication devices, it has drawbacks. One significant drawback is that the antenna is external to the body of the communication device. This places the antenna in an exposed position where it may be accidentally or deliberately damaged.

A related antenna is an external quarter wave single or multi-band asymmetric wire dipole. This antenna operates much like the aforementioned antenna, but requires an additional quarter wave conductor to produce additional resonances. This type of antenna has drawbacks similar to the aforementioned antenna.

Another type of antenna is a patch antenna. The patch antenna is a small, low profile antenna which is useful in wireless communication devices. They typically have operating bandwidths (2:1 VSWR) on the order of a few percent. The operating bandwidth may be increased by adding parasitic elements. However, the total size of the antenna increases proportionately. The front to back ratio is usually poor unless the ground plane size is also increased. Thus, in creating a patch antenna with a relatively large bandwidth, the primary advantage of the patch antenna is defeated.

There exists a need for an antenna assembly which is compact and lightweight. There is also a need for an antenna assembly which is able to receive and transmit electromagnetic frequencies at one or more frequency bands. There is a need for an antenna assembly with a reduced specific absorption rate. There is also a need for an antenna assembly which can be tuned to one or more frequency bands.

SUMMARY OF THE INVENTION

A dual frequency wideband antenna assembly for use in a wireless communication device. The antenna assembly includes first and second conductive surfaces, each having a first arm and a second arm which define a notch. The first and second conductive surfaces are in substantial collateral relation and include a dielectric member interposed therebetween in a laminar fashion. A conducting element operatively connects the first and second conductive surfaces to each other along predetermined edges, respectively. The first arms of the first and second conductive surfaces and a portion of the conducting element comprise a first radiating element, and the second arms of the first and second conductive surfaces and another portion of the conducting element comprise a second radiating element. In one embodiment, the first and second radiating elements are effectively operable over the ranges of 880–960 MHz and 1710–1880 MHz, respectively. The antenna assembly is spaced a predetermined distance from the ground plane of a printed wiring board, and is operatively connected thereto at several predetermined locations by several components. One component, a capacitor, operatively connects an end of one of the arms of first radiating element to a ground plane. Another component, a feed element, operatively connects the second radiating element to the signal conductor of the device. And, a third component, a grounding element, operatively connects the second radiating element to the ground plane. Since the distance between the antenna assembly and the ground plane is a function of the particular wavelengths used, the space between the antenna assembly and the ground plane may vary. However, it will be appreciated that various componentry may be positioned within the open space(s) between the antenna assembly and the ground plane to facilitate compact construction. The antenna assembly so constructed, provides a two-to-one voltage standing wave ratio with bandwidths of around 15 percent that has a low specific absorption rate and is particularly useful in wireless communication devices such as cellular telephones.

It is an object of the present invention to provide an antenna assembly which may be incorporated into a wireless communication device.

It is an object of the present invention to enhance operation of an antenna assembly by increasing its operational bandwidths.

It is an object of the present invention to increase the operational parameters of a wireless communication device by providing two or more complimentary radiating elements.

A feature of the present invention is that the radiating elements of the antenna assembly are tunable over a range of frequencies.

Another feature of the present invention is that there is a single feed point for multiple electromagnetic frequency bands.

An advantage of the present invention is that the antenna assembly has a low profile which enables it to be used in small articles such as wireless communication devices.

Another advantage of the present invention is that various components of a transceiver device may be positioned within interior regions of the antenna assembly to reduce the overall size of the electronic device.

These and other objects, features and advantages will become apparent in light of the following detailed description of the preferred embodiments in connection with the drawings.

DETAILED DESCRIPTION OF THE PREFERRED EMBODIMENTS

Figure 1:
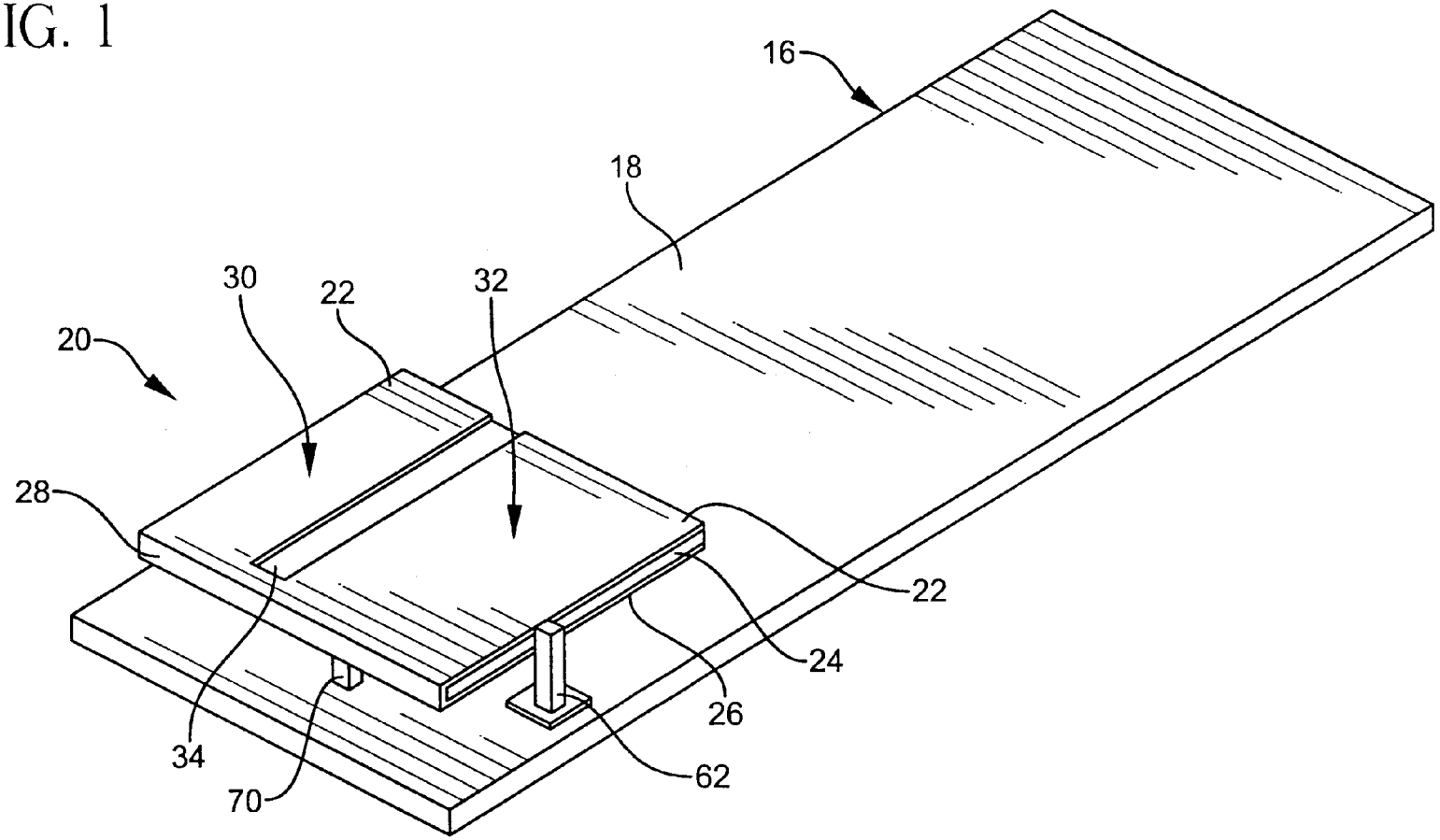
FIG. 1 is an attachment end perspective view of an antenna assembly according to the present invention operatively connected to an end portion of a printed wiring board.

Referring now to the drawings, wherein like numerals depict like parts throughout, FIG. 1 illustrates an antenna assembly 20 according to the present invention. The antenna assembly 20, according to the present invention, includes a first conductive surface 22, a dielectric member 24 and a second conductive surface 26 (See, FIGS. 3A and 4) collaterally aligned with each other in a generally laminar fashion. The first and second conductive surfaces 22, 26 are electrically connected to each other along respective edges by a conducting element 28. As depicted, the antenna assembly 20 is disposed at an end portion of a printed wiring board (PWB) 16 in parallel therewith, and is operatively connected to the PWB 16 by a plurality of connection components. One component is a feed element 62, one end of which is operatively connected at a predetermined position along an edge of the first conductive surface 22. The other end of the feed element 62 is operatively connected to the PWB 16 for connection to an RF signal port of the device. The feed element 62 may be a coaxial cable, a microstrip line or other suitable connector. A second connection component is a grounding element 70. The grounding element 70 has two ends, one end of which is attached to the second conductive surface 26 of the antenna assembly 20. More specifically, the one end is attached to the second arm 42 of the second conductive surface 26 (See FIG. 4). As with the feed element 62, the grounding element 70 may be a coaxial cable, a microstrip line or other suitable connector. The other end of the grounding element 70 is operatively connected to the ground plane 18 in a conventional manner. A third connection component is a capacitor 52 and is depicted in FIGS. 2–5. The capacitor 52 has two ends, one end of which is operatively connected at a predetermined position along an edge of the second conductive surface 26. More specifically, the one end of the capacitor 52 is connected at an edge of the first arm 40 of the second conductive surface 26. The other end of the capacitor 52 is operatively connected to the ground plane 18 in a conventional manner. Preferably, the capacitor 52 is adjustable and has a value of approximately 0.6 pF for its operational frequency of 880–960 Mhz.

Figure 2:
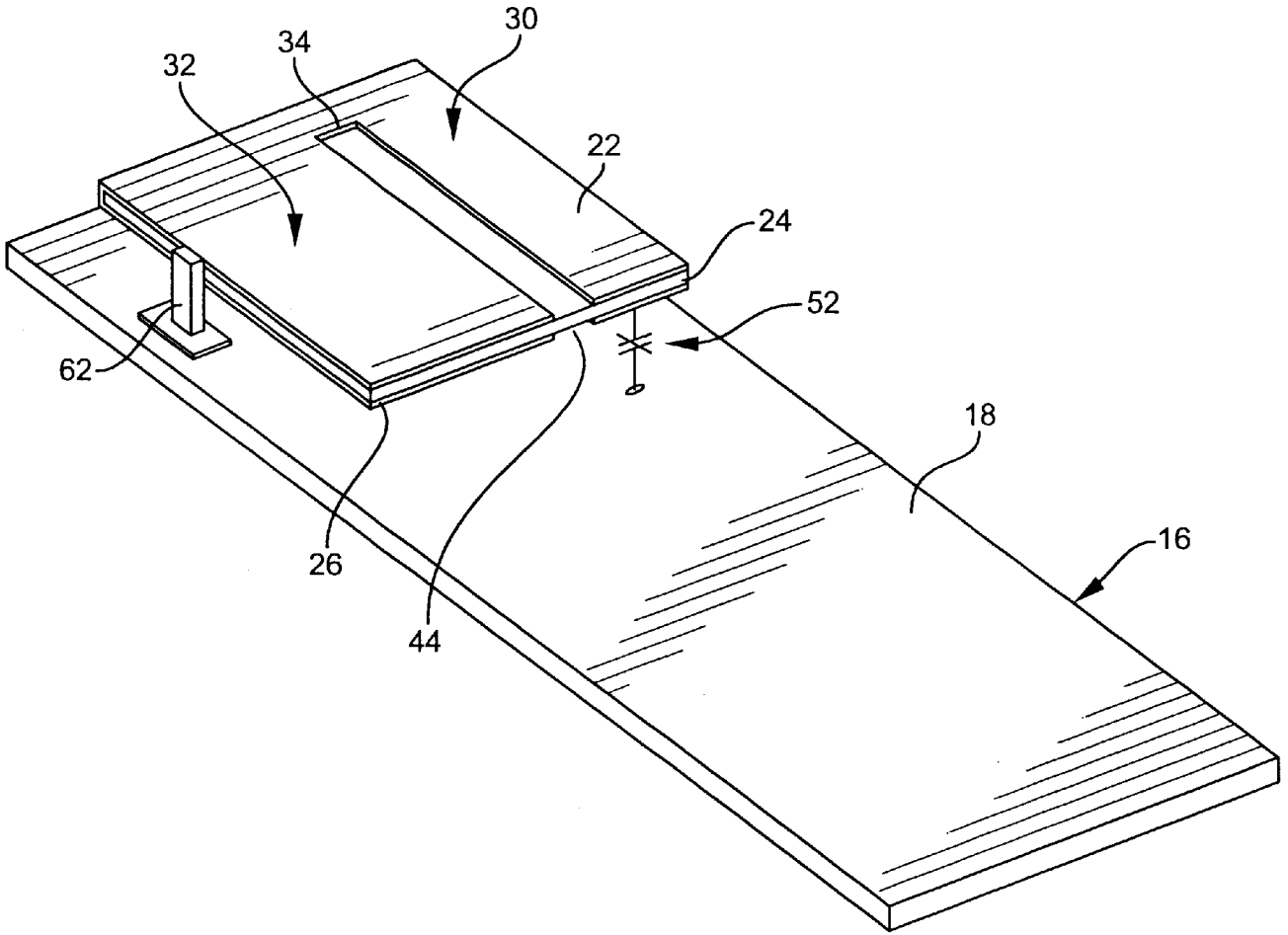
FIG. 2 is a free end perspective view of the antenna assembly according to the present invention operatively connected to an end portion of a printed wiring board.

As depicted in FIG. 2, the first conductive surface 22 of the antenna assembly 20 includes a first arm 30 and a second arm 32 with a gap or notch 34 therebetween. This configuration is mirrored by the collaterally aligned second conductive surface 26 (See FIG. 4) which includes a first arm 40 and a second arm 42 with a gap or notch 44 therebetween. The gap 34 size is approximately 3 mm across. While the first and second conductive surfaces 22, 26 are depicted as being distinct from the dielectric element 24, it is understood that the first and second conductive surfaces may be integrally formed onto the dielectric member by such methods as metal deposition and/or etching. The dielectric member 24 is of a material that has a dielectric constant of between 1.0 and 10.0, and a preferred value of between 1 and 3. This results in an overall thickness of the first and second conductive surfaces and the dielectric member of around 1.5 mm.

Figure 4:
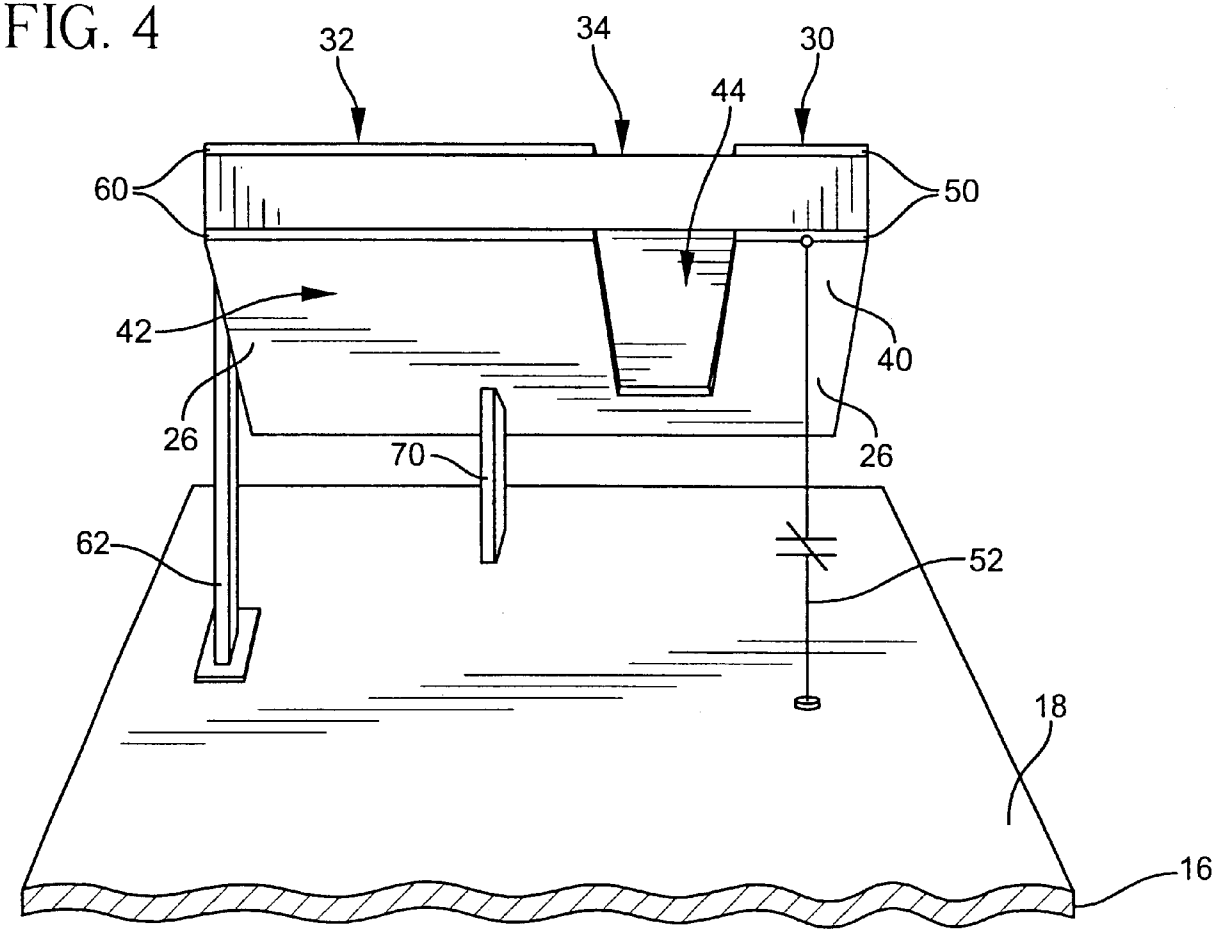
FIG. 4 is a is a fragmentary perspective view of the antenna assembly according to the present invention taken from the free end of a printed wiring board; and, FIG. 5 is a fragmentary top plan view of the antenna assembly of the present invention relative to a printed wiring board.
Figure 5:
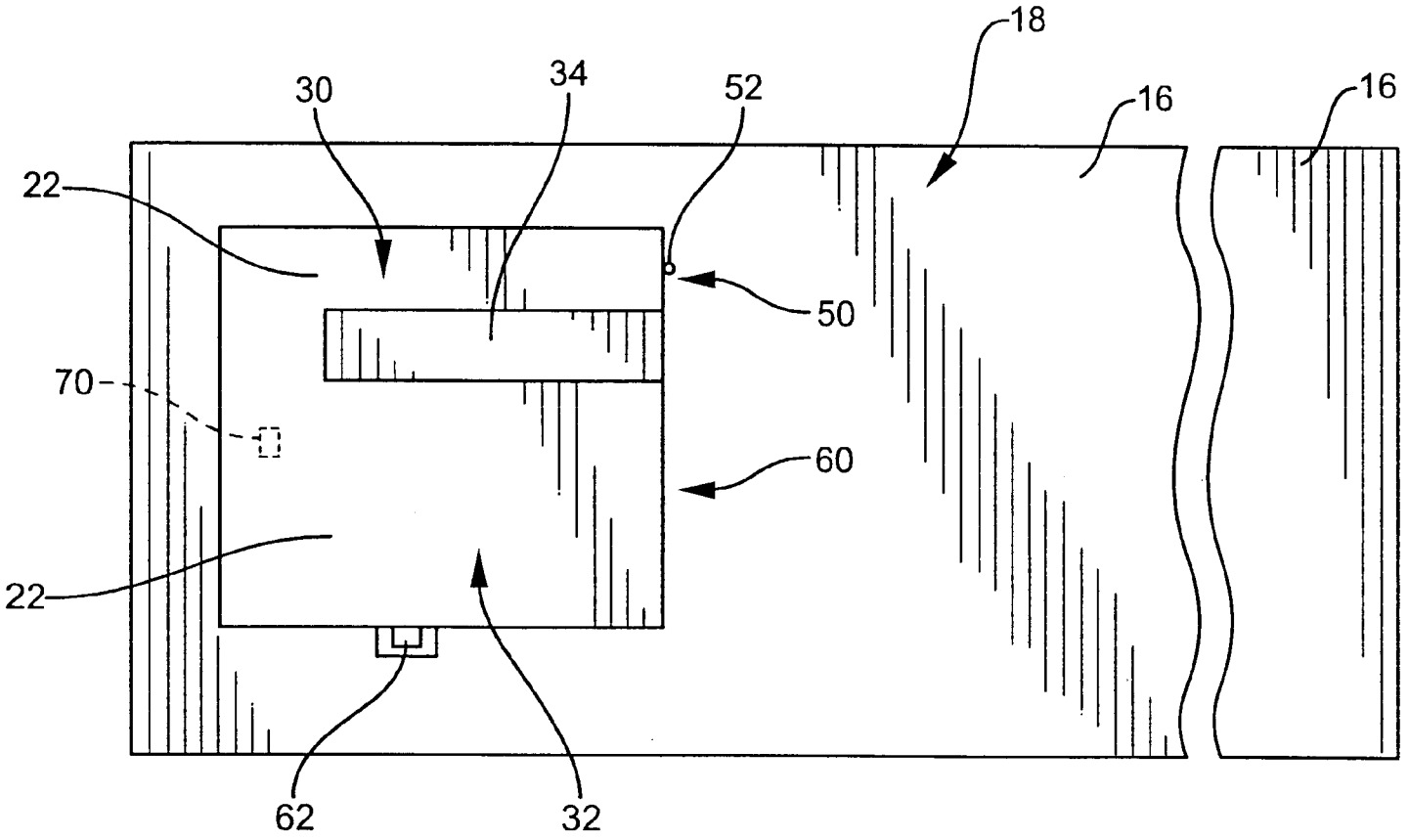

Turning to FIGS. 4 and 5, the first arms 30, 40 of the first and second conductive surfaces 22, 26 and a portion of the conducting element 28 form a first radiating element 50, while the second arms 32, 42 of the first and second conductive surfaces 22, 26 and a portion of the conducting element 28 form a second radiating element 60. In the illustrated embodiment, the first radiating element 50 has a preferred operational frequency of around 880–960 MHz while the second radiating element 60 has a preferred operational frequency of around 1710–1880 MHz. It will be appreciated that the radiators 50, 60 may be tailored to operate at various predetermined frequencies. The first radiating element 50 may be adjusted by adjusting the capacitance value of capacitor 52, while the second radiating element 60 may be adjusted by varying the length of the arms 32, 42. For example, an operational frequency of 1710–1880 MHz requires that the length of the second radiating element 60 be around 34 mm.

Figure 3A:
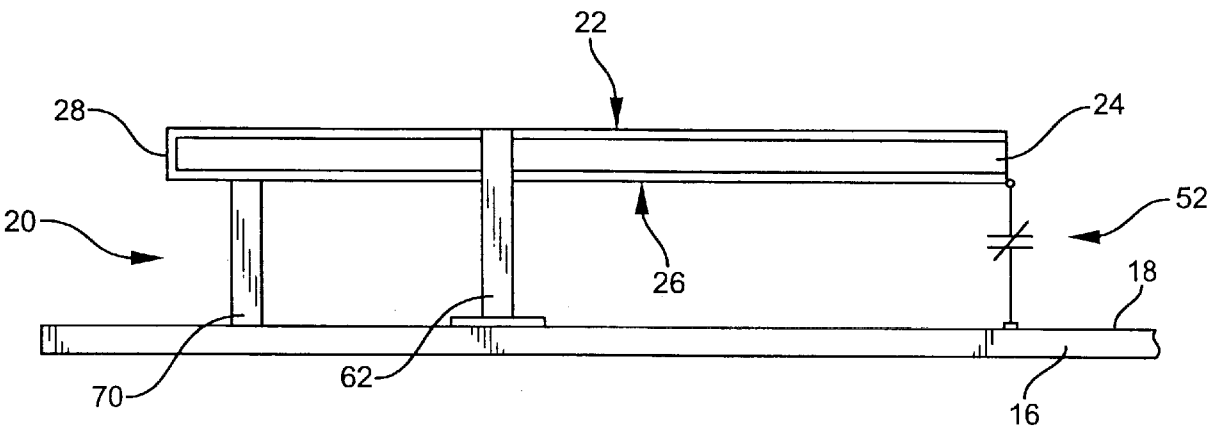
FIG. 3A is a side elevational view of the antenna assembly according to the present invention.
Figure 3B:
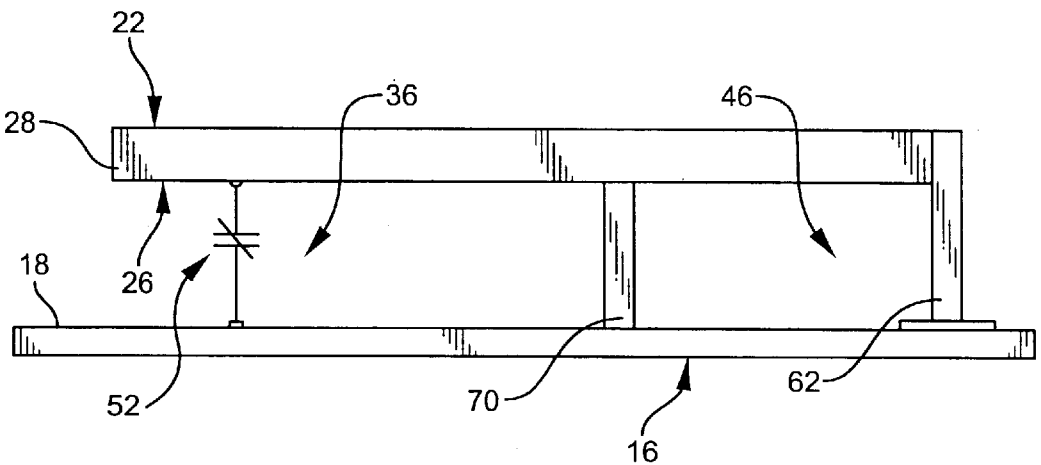
FIG. 3B is an end elevational view of the antenna assembly according to the present invention.

As depicted in FIGS. 3A, 3B and 4, the antenna assembly 20 is positioned a predetermined distance above and substantially parallel to the ground plane 18. This predetermined distance is a function of the operational wavelength, which, in the preferred embodiment, results in a distance of around 6 mm. Note that in spacing the antenna assembly 20 from the ground plane 18 interior regions 36, 46 are formed between and defined by the first and second arms 40, 42 of the second conductive surface 26, respectively, and the ground plane 18. Advantageously, these interior regions 36, 46 may be used to receive various components of a wireless communication device to form a more compact overall package.

As mentioned previously, one end of the feed element 62 is operatively connected to the second radiating element 60 at a predetermined location on an edge of the second arm 32 of the first conductive surface 22 (See FIG. 3A). In the preferred illustrated embodiment, this location is around 13 mm from the conducting element 28. The other end of the feed element 62 is operatively connected to the PWB 16 for connection to an RF signal port or line of the device. The grounding element 70, on the other hand, is located inboard, that is away from the edges of the second conductive surface 26. Preferably, the grounding element 70 is situated about 14 mm from the edge of the second radiating element 60 at which the feed element 62 is connected, and operatively connects the second radiating element 60 to the ground plane 18 in a conventional manner.

The juxtaposition of the antenna assembly 20 and the printed wiring board 16 can be seen in FIG. 5. The printed wiring board 16 has a length of around 125 mm and a width of around 42 mm. As can be seen, the antenna assembly 20 is arranged so that the conducting element 28 is spaced about 5 mm from a first edge of the printed wiring board 16, and is more or less centrally located with respect to the width thereof.

A preferred method of fabrication of the antenna assembly 20 according to the present invention includes steps of punching and bending a metal sheet into the illustrated configuration. Various metal processing techniques and approaches will be appreciated by those skilled in the art to fabricate an antenna assembly 20 according to the present invention.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed:

1. An antenna assembly for use in a wireless communications device, the antenna assembly comprising:

a first generally c-shaped radiating element having an upper conductive surface, a lower conductive surface, and an intermediate conductive surface, said first radiating element having a predetermined size effective to resonate at wavelengths within a first predetermined resonant band;

a second generally c-shaped radiating element operatively connected to the first radiating element and having an upper conductive surface, a lower conductive surface, and an intermediate conductive surface, said second radiating element having a predetermined size effective to resonate at wavelengths within a second predetermined resonant band which is substantially different that the first resonant band, said second radiating element being disposed adjacent the first radiating element and being conductively coupled to the first radiating element;

a capacitor operatively coupling the first radiating element to a ground plane;

a feed element operatively connecting the second radiating element to an RF signal port of the wireless communications device; and, a grounding element operatively connecting the second radiating element to the ground plane; with the first radiating element and the ground plane defining a first open space therebetween, and with the second radiating element and the ground plane defining a second open space therebetween.

2. The antenna assembly of claim 1, wherein the upper conductive surfaces of the first and second radiating elements are substantial coplanar.

3. The antenna assembly of claim 1 wherein one end of the feed element is operatively connected to the second radiating element at a predetermined position.

4. The antenna assembly of claim 3, wherein the predetermined position is an edge.

5. The antenna assembly of claim 4, wherein the edge faces away from the first radiating element.

6. The antenna assembly of claim 1, wherein one end of the capacitor is operatively connected to the first radiating element at a predetermined position.

7. The antenna assembly of claim 6, wherein the predetermined position is an edge.

8. An antenna assembly for use in a wireless communications device, the antenna assembly comprising:

a first conductive surface defining a pair of conductive portions separated by a notch structure, the pair of conductive portions being substantially different in size, said first conductive surface being in generally parallel alignment with a ground plane element of the wireless communications device;

a dielectric element having opposing sides, with one side adjacent the first conductive surface;

a second conductive surface defining a pair of conductive portions separated by a notch structure, the pair of conductive portions being substantially different in size, the second conductive surface being in generally parallel alignment with the ground plane element of the wireless communications device, the second conductive surface adjacent another side of the dielectric element, said notch structures of the first and second conductive surfaces being aligned generally opposite each other across the dielectric element;

a conducting element operatively connecting the first conductive surface to the second conductive surface;

a capacitor operatively coupling the second conductive surface to the ground plane element;

a feed element operatively connecting the first conductive surface to an RF signal port of the device; and a grounding element operatively connecting the second conductive surface to the ground plane element.

9. The antenna assembly of claim 8, wherein the first and second conductive surfaces are substantially collateral and have at least one edge, respectively, and wherein the conducting element operatively connects the first and second conductive surfaces along a predetermined length of the at least one edge of the first and second conductive surfaces.

10. The antenna assembly of claim 8, wherein the first conductive surface includes a first arm and a second arm, and the second conductive surface includes a first arm and a second arm.

11. The antenna assembly of claim 8, wherein the first and second conductive surfaces are in spaced relation from the ground plane.

12. The antenna assembly of claim 11, wherein the first and second conductive surfaces are substantially planar.

13. The antenna assembly of claim 12, wherein the first and second conductive surfaces are substantially collateral.

14. The antenna assembly of claim 8, wherein a first end of the feed element is operatively connected to the first conductive surface at a predetermined position.

15. The antenna assembly of claim 14, wherein the predetermined position is an edge.

16. The antenna assembly of claim 8, wherein one end of the capacitor is operatively connected to the second conductive surface at a predetermined position.

17. The antenna assembly of claim 16, wherein the predetermined position is an edge.

18. The antenna assembly of claim 8, wherein the capacitor is adjustable.

19. A dual frequency wideband antenna assembly for use in a wireless communication device, the antenna assembly comprising:

a first generally c-shaped radiating element having an upper conductive surface, a lower conductive surface, and an intermediate conductive surface, said first radiating element having a predetermined size effective to resonate at wavelengths within a first predetermined resonant band;

a second generally c-shaped radiating element operatively connected to the first radiating element and having an upper conductive surface, a lower conductive surface, and an intermediate conductive surface, said second radiating element having a predetermined size effective to resonate at wavelengths within a second predetermined resonant band which is substantially different that the first resonant band, said second radiating element being disposed adjacent the first radiating element;

a dielectric member interposed between the first and second radiating elements;

a conducting element operatively connecting the first radiating element to the second radiating element;

a capacitor operatively connecting the first radiating element to a ground plane;

a feed element operatively connecting the second radiating element to an RF signal port of the wireless communication device; and a grounding element operatively connecting the second radiating element to the ground plane.

20. A dual frequency wideband antenna assembly for use in a wireless communication device, the antenna assembly comprising:

a first generally c-shaped radiating element having two substantially collateral arms with a first portion of a dielectric member disposed therebetween;

a second generally c-shaped radiating element having two substantially collateral arms with a second portion of the dielectric member disposed therebetween, wherein the second radiating element is operatively connected to the first radiating element and wherein the first and second radiating elements are arranged in a substantially coplanar relation;

a capacitor operatively coupling one of the arms of first radiating element to a ground plane; a feed element operatively connecting one of the arms of the second radiating element to an RF signal port of the wireless communication device; and, a grounding element operatively connecting the second radiating element to a ground plane; with the first radiating element and the ground plane defining a first open space therebetween, and the second radiating element and the ground plane defining a second open space therebetween.

* * * * *